US009639111B2

(12) United States Patent
Camli et al.

(10) Patent No.: US 9,639,111 B2
(45) Date of Patent: May 2, 2017

(54) HOUSEHOLD APPLIANCE COMPRISING A KNOB THE OUTER PERIPHERY OF WHICH IS ILLUMINATED

(75) Inventors: Ugur Camli, Istanbul (TR); Mehmet Baris Gocer, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 533 days.

(21) Appl. No.: 13/977,715

(22) PCT Filed: Dec. 20, 2011

(86) PCT No.: PCT/EP2011/073372

§ 371 (c)(1),
(2), (4) Date: Nov. 5, 2013

(87) PCT Pub. No.: WO2012/089556

PCT Pub. Date: Jul. 5, 2012

(65) Prior Publication Data

US 2014/0047944 A1 Feb. 20, 2014

(30) Foreign Application Priority Data

Dec. 31, 2010 (TR) ..... a 2010 11261

(51) Int. Cl.
*G05G 1/10* (2006.01)
*F24C 3/12* (2006.01)
(Continued)

(52) U.S. Cl.
CPC ..... *G05G 1/10* (2013.01); *F24C 3/126* (2013.01); *F24C 7/082* (2013.01); *G05G 1/08* (2013.01);
(Continued)

(58) Field of Classification Search
CPC . G05G 1/105; G05G 1/12; G05G 1/10; F24C 7/082; H01H 19/025; H01H 19/02;
(Continued)

(56) References Cited

U.S. PATENT DOCUMENTS 2,541,892 A * 2/1951 Schulze ..... 116/310
2,738,758 A * 3/1956 Cutler et al. ..... 116/250
(Continued)

FOREIGN PATENT DOCUMENTS

EP 176817 A1 * 4/1986
EP 179246 A1 * 4/1986
(Continued)

OTHER PUBLICATIONS

EPO Translation of Description of EP 0176817 A1, Apr. 9, 1986.*

*Primary Examiner* — Daniel Yabut
(74) *Attorney, Agent, or Firm* — Kilpatrick Townsend & Stockton LLP

(57) ABSTRACT

The present invention relates to a household appliance (1) comprising a control panel (2), a push-pull type and rotary knob (3) which is disposed to the control panel (2), a casing (5) which is produced from plastic, fixed to the back side of the control panel (2) and which forms a housing for the knob (3), and which has a cylindrical side wall (4), more than one light source (8) which provides the periphery of the knob (3) to be illuminated by emitting light, a printed circuit board (9) whereon the light sources (8) are integrated and a light guide (14) which transmits the light received from the light sources (8) to the periphery of the knob (3).

1 Claim, 4 Drawing Sheets

Figure 1:
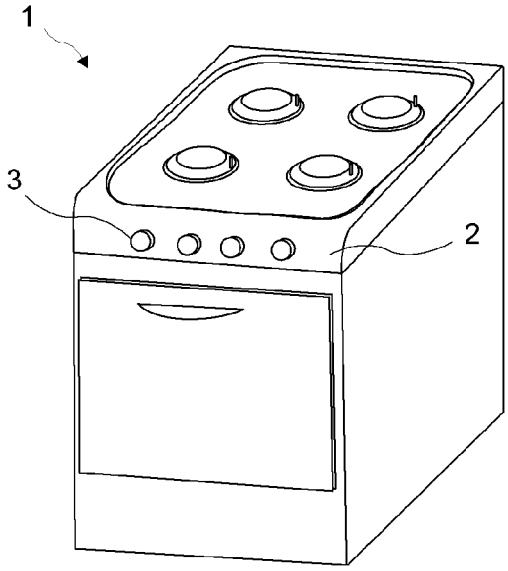

(51) Int. Cl.

| | |
|---|---|
| ***F24C 7/08*** | (2006.01) |
| ***G05G 1/08*** | (2006.01) |
| *H01H 19/02* | (2006.01) |

(52) U.S. Cl.
CPC ..... *G05G 1/105* (2013.01); *H01H 19/025* (2013.01); *H01H 2219/0622* (2013.01); *Y10T 74/2084* (2015.01)

(58) Field of Classification Search
CPC ..... H01H 2019/008; H01H 2219/0622; Y10T 74/2084
See application file for complete search history.

(56) References Cited

U.S. PATENT DOCUMENTS

| | | | | |
|---|---|---|---|---|
| 5,335,148 | A * | 8/1994 | Tominaga | 362/23.21 |
| 2003/0112160 | A1 * | 6/2003 | Hsiung et al. | 341/31 |

FOREIGN PATENT DOCUMENTS

| | | | |
|---|---|---|---|
| EP | 276463 | A2 * | 8/1988 |
| JP | 2001060125 | A * | 3/2001 |

* cited by examiner

HOUSEHOLD APPLIANCE COMPRISING A KNOB THE OUTER PERIPHERY OF WHICH IS ILLUMINATED

The present invention relates to a household appliance comprising a knob disposed on the control panel and the outer periphery of which is illuminated.

On the control panel of the household appliances, for instance cooking devices, knobs, which provide the household appliance to be operated, are disposed. In terms of ease of use and decorative appearance, the periphery of the knobs is illuminated. In order to illuminate the periphery of the knobs, generally light emitting diode (LED) light bulbs integrated to a printed circuit board (PCB) are used. Since the printed circuit boards are required to be disposed to the limited area behind the knob, problems occur during the production and the labor hours spent for intervention in case of a malfunction is increased.

In the U.S. Pat. No. 6,876,313, a rotary knob that is illuminated by the illuminant elements connected to the printed circuit board is explained.

In the Japanese Patent Application No. JP8097014, a knob structure is explained wherein the circumference is lighted and the number of parts and labor hours are reduced.

The aim of the present invention is the realization of a household appliance comprising knobs, wherein the outer periphery is illuminated and ease of assembly is provided.

On the control panel of the household appliance realized in order to attain the aim of the present invention and explicated in the claims, at least one knob is located and the periphery of the knob is illuminated by the LEDs disposed into the knob casing at the inner side of the control panel.

The LEDs are integrated to a printed circuit board and the printed circuit board is mounted to the knob casing by being inserted around it by means of an opening located at the center of the printed circuit board.

In the position the LEDs are seated in the assembly holes on the casing, the printed circuit board is locked snap-fittingly onto the casing by means of a locking detent. The locking detent prevents the printed circuit board from being dislodged.

In the embodiment of the present invention, furthermore, the LEDs located on the printed circuit board are mounted snap-fittingly to the assembly holes on the knob casing. The plastic bodies of the LEDs function as fixing means and additional elements to fix the LEDs are not used.

The printed circuit board and the LED group are assembled to the knob casing snap-fittingly and in a detachable manner and hence, saving in number of parts and the labor hours is provided.

The household appliance realized in order to attain the aim of the present invention is illustrated in the attached figures, where:

FIG. 1—is the perspective view of a household appliance.

Figure 2:
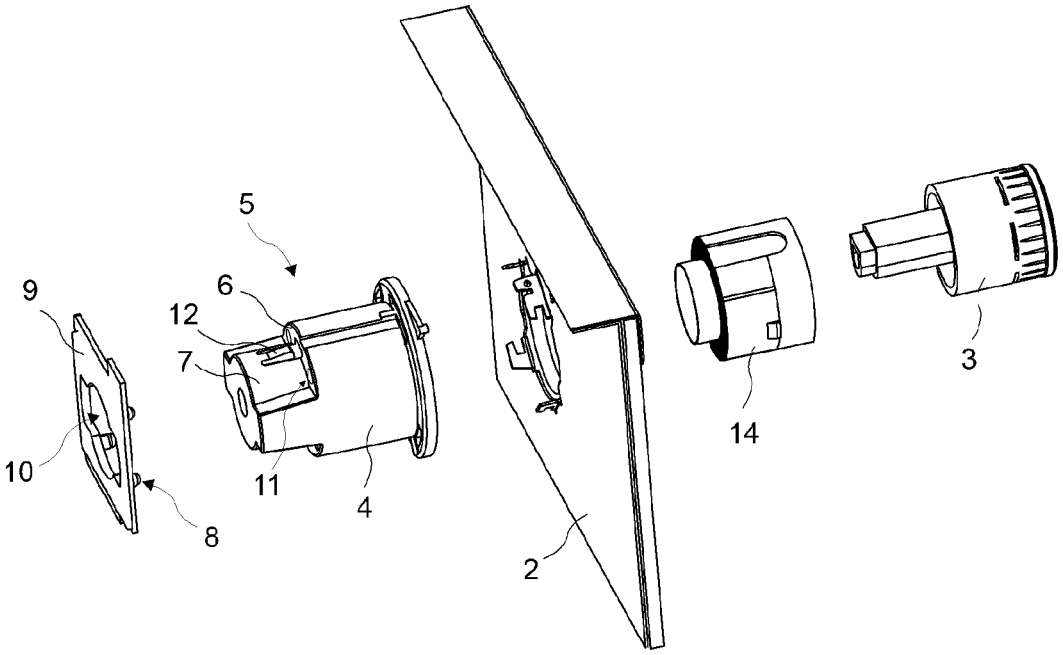

FIG. 2—is the exploded view of a control panel, a knob, a knob casing and a LED board.

Figure 3:
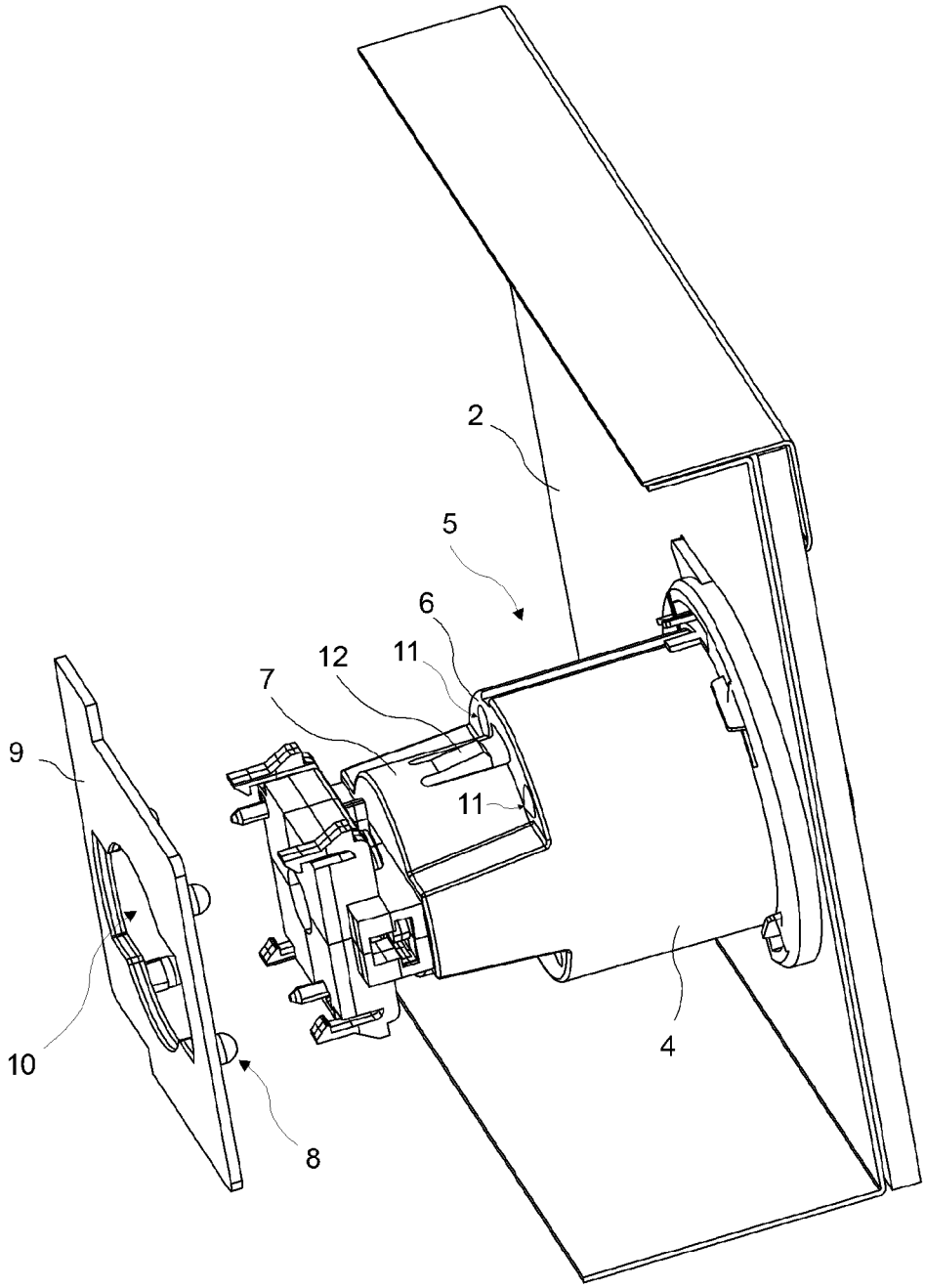

FIG. 3—is the perspective view of a control panel, a knob casing and a LED board in before being assembled.

Figure 4:
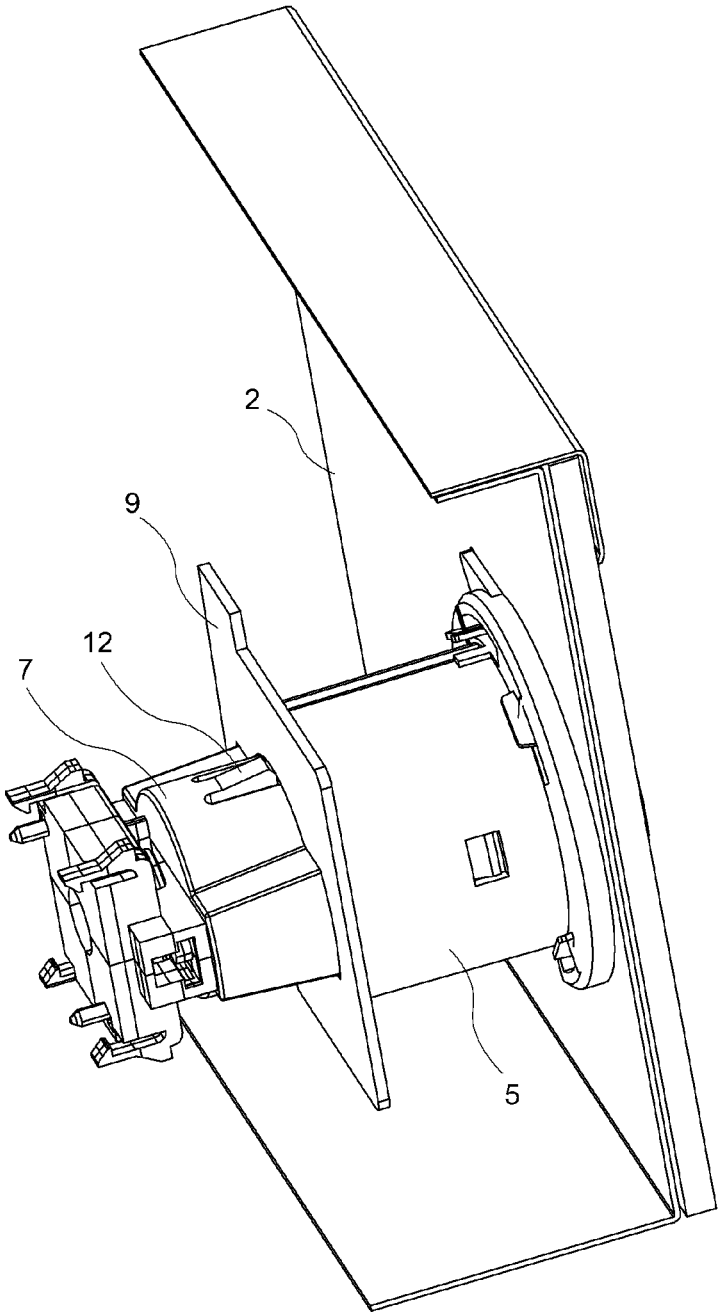

FIG. 4—is the perspective view of a control panel, a knob casing and a LED board in assembled state.

Figure 5:
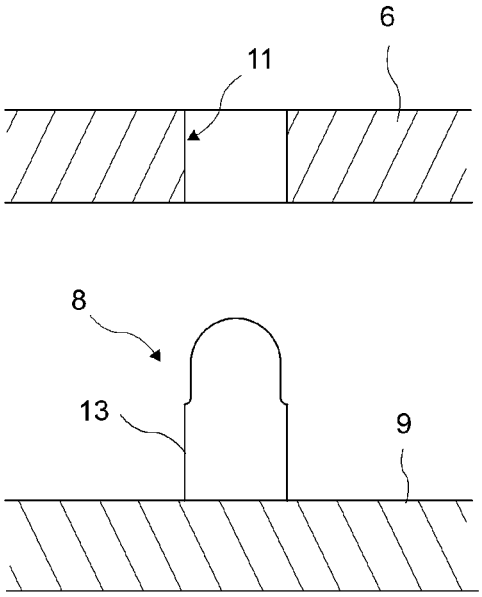

FIG. 5—is the schematic view of a LED, a LED board and an assembly hole located on the knob casing.

Figure 6:
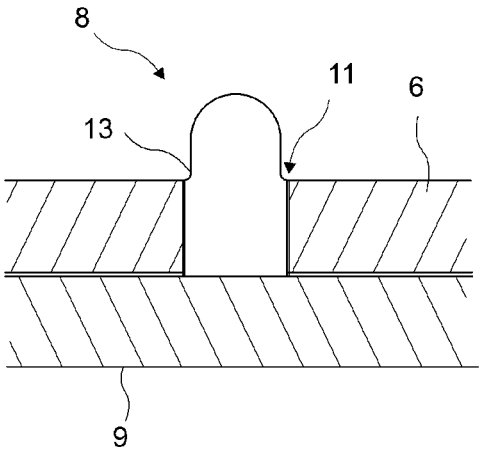

FIG. 6—is the schematic view of a LED, a LED board and a knob casing in assembled state.

The elements illustrated in the figures are numbered as follows:

1. Household appliance
2. Control panel
3. Knob
4. Side wall

5. Casing
6. Support wall
7. Guiding part
8. Light source
9. Printed circuit board
10. Opening
11. Assembly hole
12. Locking detent
13. Body
14. Light guide The household appliance (1) comprises a control panel (2), a push-pull type and rotary knob (3) which is disposed to the control panel (2), a casing (5) which is produced from plastic, fixed to the back side of the control panel (2) and forms a housing for the knob (3), and which has a cylindrical side wall (4), a planar support wall (6) which is vertical to the side wall (4) forming a gradual structure almost at the center of the casing (5), a guiding part (7) which is produced as one piece with the casing (5) and has hollow, cylindrical side walls extending from the support wall (6) backwards as an extension of the casing (5), more than one light source (8) which is assembled to the casing (5) and provides the periphery of the knob (3) to be illuminated by emitting light into the casing (5), a printed circuit board (9) whereon the light sources (8) are integrated, an opening (10) which is located at the center of the printed circuit board (9) and provides it to be assembled to the casing (5), more than one assembly hole (11) wherein the light sources (8) are assembled and which is located on the support wall (6), and a light guide (14) which is disposed into the casing (5) and transmits the light received from the light sources (8) to the periphery of the knob (3).

The household appliance (1) of the present invention comprises

- a printed circuit board (9) which is mounted to the casing (5) by being inserted onto the guiding part (7) by means of the opening (10) and joined with the support wall (6) surface-to-surface, and the light sources (8) on which are mounted to the assembly holes (11), and
- at least one flexible locking detent (12) which is connected to the guiding part (7) and which extends in a curved manner towards the support wall (6) such that a distance remains between itself and the support wall (6) as much as the thickness of the printed circuit board (9) by opening outwards from the cylindrical side walls of the guiding part (7), and which provides the printed circuit board (9) to be assembled to the casing (5) snap-fittingly by bearing against the back surface of the printed circuit board (9) in the position the printed circuit board (9) bears against the support wall (6) and the light sources (8) are mounted to the assembly holes (11).

While being assembled to the casing (5), the printed circuit board (9) is inserted onto the guiding part (7) by means of the opening (10) at the center of the printed circuit board (9) and is slid on the guiding part (7) towards the support wall (6) in the axial direction. The guiding part (7) is in a form matching with the contour of the opening (10) and bears the printed circuit board (9) during assembly. While the printed circuit board (9) is slid on the guiding part (7), the contours of the opening (10) stretch the locking detents (12) inwardly, that is, towards the guiding part (7) whereto the locking detents (12) are connected, by bearing against the locking detents (12), and at the moment the printed circuit board (9) bears against the support wall (6), the locking detents (12) become free from the contours of the opening (10) and change to the free position and provide the printed circuit board (9) to be locked to the casing (5) snap-fittingly while contacting the support wall (6) by bearing against the back surface of the printed circuit board (9). In case of any malfunction, for example when the need of changing the light sources (8) is required, the locking detents (12) are stretched by being pressed towards the guiding part (7) they are connected to (inwardly) and release the printed circuit board (9), and the printed circuit board (9) is easily removed from the casing (5) by being pulled backwards on the guiding part (7).

In the household appliance (1), for illuminating the knob (3), a LED light bulb having a transparent plastic body (13) such as epoxy or polycarbonate is used as light source (8). The plastic body (13) is known as "lens" in the relevant technical field (FIG. 5, FIG. 6).

In an embodiment of the present invention, the plastic body (13) of the light source (8) is used as fixing means and during production, the diameter dimension of the assembly holes (11) on the support wall (6) of the casing (5) are adjusted so as to be mounted snap-fittingly to the body (13) with standard dimensions. Thus, the printed circuit board (9), whereto the light sources (8) are connected, is prevented from being stretched and the light sources (8) from being released from the assembly hole (11) (FIG. 5, FIG. 6).

During the assembly of the printed circuit board (9) to the casing (5), the plastic bodies (13) of the light sources (8) are used as fixing means and the light sources (8) are provided to be snap-fittingly fixed to the assembly holes (11) directly without using an additional fixing part. Since the body (13) and the assembly hole (11) are produced from plastic material, applying extra force during the snap-fitting process is not required. The light sources (8) are assembled to the assembly holes (11) in a detachable manner by providing a connection similar to clickable connections.

In the household appliance (1) of the present invention, the printed circuit board (9), whereto the light sources (8) providing the periphery of the knob (3) to be illuminated are integrated, is assembled to the knob (3) casing (5) snap-fittingly in a detachable manner and hence, ease of production and maintenance is provided.

It is to be understood that the present invention is not limited by the embodiments disclosed above and a person skilled in the art can easily introduce different embodiments. These should be considered within the scope of the protection postulated by the claims of the present invention.

The invention claimed is:

1. A household appliance (1) comprising a control panel (2), a knob (3) which is disposed to the control panel (2), a casing (5) which is fixed to a back side of the control panel (2), which forms a housing for the knob (3) and has a cylindrical side wall (4) and a planar support wall (6) which is vertical to the side wall (4), a guiding part (7) which is produced as one piece with the casing (5) and extends from a base of the planar support wall (6) backwards away from the planar support wall (6) wherein the planar support wall forms a structure between the control panel (2) and the guiding part (7), more than one light source (8) which is assembled to the casing (5) and provides a periphery of the knob (3) to be illuminated by emitting light into the casing (5), a printed circuit board (9) whereon the light sources (8) are integrated, an opening (10) which is located at the center of the printed circuit board (9) for assembling the printed circuit board (9) to the casing (5), and more than one assembly hole (11) wherein the light sources (8) are assembled and which is located on the support wall (6), wherein the printed circuit board (9) is mounted to the casing (5) by being inserted onto the guiding part (7) by means of the opening (10) and which is joined with the support wall (6) surface-to-surface, and further comprising at least one flexible locking detent (12) which is disposed on the guiding part (7) and which extends towards the support wall (6) by opening outwards from the guiding part (7) and which provides the printed circuit board (9) to be assembled to the casing (5) snap-fittingly by bearing against the back surface of the printed circuit board (9) in the position the light sources (8) are mounted to the assembly holes (11).

* * * * *